US008342824B2

(12) United States Patent
Süss et al.

(10) Patent No.: US 8,342,824 B2
(45) Date of Patent: Jan. 1, 2013

(54) PISTON COMPRESSOR, PARTICULARLY REFRIGERANT COMPRESSOR

(75) Inventors: Jürgen Süss, Soenderborg (DK); Christian Jepsen, Soenderborg (DK)

(73) Assignee: Danfoss A/S, Nordborg (DK)

( * ) Notice: Subject to any disclaimer, the term of this patent is extended or adjusted under 35 U.S.C. 154(b) by 336 days.

(21) Appl. No.: 12/536,711

(22) Filed: Aug. 6, 2009

(65) Prior Publication Data

US 2010/0172779 A1 Jul. 8, 2010

(30) Foreign Application Priority Data

Aug. 14, 2008 (DE) ..... 10 2008 037 672

(51) Int. Cl.
*F04B 39/10* (2006.01)
*F04B 53/10* (2006.01)

(52) U.S. Cl. ..... 417/571; 137/315.33; 137/856

(58) Field of Classification Search ..... 417/571, 417/569; 137/315.33, 855, 856
See application file for complete search history.

(56) References Cited

U.S. PATENT DOCUMENTS

| | | | | |
|---|---|---|---|---|
| 4,098,296 | A * | 7/1978 | Grasso et al. | 137/855 |
| 5,456,287 | A * | 10/1995 | Leu | 417/571 |
| 7,390,177 | B2 * | 6/2008 | Iversen et al. | 417/569 |
| 2006/0067844 | A1 | 3/2006 | Iversen | |

FOREIGN PATENT DOCUMENTS

| | | | |
|---|---|---|---|
| DE | 103 30 760 | B4 | 2/2005 |
| DE | 10 2004 047 159 | B4 | 4/2006 |

* cited by examiner

*Primary Examiner* — Peter J Bertheaud
(74) *Attorney, Agent, or Firm* — McCormick, Paulding & Huber LLP

(57) ABSTRACT

A piston compressor, particularly a refrigerant compressor includes a compression chamber in a compressor block, the compression chamber being delimited by a cylinder head (10), the cylinder head (10) comprising at least one valve plate arrangement with at least one suction valve (23, 24) and at least one pressure valve (21, 22), as well as a valve cover (12). To achieve low manufacturing costs, though maintaining a good efficiency, the valve plate arrangement (16) is formed by a carrier plate (17) that comprises the suction valve (23, 24, 26, 27) and the pressure valve (18, 19, 21, 22) and is connected by at least one gas-tight connection seam (28, 31) to the valve cover (12), the connection seam (28, 31) separating a suction area (32) and a pressure area (29, 30) from one another and sealing at least the pressure area (29, 30) towards the outside.

4 Claims, 3 Drawing Sheets

PISTON COMPRESSOR, PARTICULARLY REFRIGERANT COMPRESSOR

CROSS REFERENCE TO RELATED APPLICATION

Applicant hereby claims foreign priority benefits under U.S.C. §119 from German Patent Application No. 10 2008 037 672.8 filed on Aug. 14, 2008, the contents of which are incorporated by reference herein.

FIELD OF THE INVENTION

The invention concerns a piston compressor, particularly a refrigerant compressor with a compression chamber in a compressor block, the compression chamber being delimited by a cylinder head, the cylinder head comprising at least one valve plate arrangement with at least one suction valve and at least one pressure valve, as well as a valve cover.

BACKGROUND OF THE INVENTION

Such a piston compressor is, for example, known from DE 10 2004 047 159 B4. The valve plate arrangement comprises a pressure valve plate and a suction valve plate. The pressure valve plate and the suction valve plate are connected to each other and the valve cover by welding. The pressure valve plate has several pressure valve elements, which are part of the pressure valve plate. In a similar manner, the suction valve plate has several suction valve elements, which are part of the suction valve plate.

DE 103 30 760 B4 shows a further piston compressor, in which, additionally to the pressure valve plate and the suction valve plate, the valve plate arrangement comprises a reinforcement plate.

Piston compressors, which are used to compress refrigerants, that is, for example, hermetic or semi-hermetic refrigerant compressors, are manufactured in large numbers. Accordingly, there is an interest in keeping the manufacturing costs low. Usually, however, low manufacturing costs involve the risk that the application properties of the compressor are deteriorated. In particular, there is a risk that the efficiency is reduced.

SUMMARY OF THE INVENTION

The invention is based on the task of achieving low costs in connection with a good efficiency.

With a piston compressor as mentioned in the introduction, this task is solved in that the valve plate arrangement is formed by a carrier plate that comprises the suction valve and the pressure valve and is connected by means of at least one gas-tight connection seam to the valve cover, the connection seam separating a suction area and a pressure area from one another and sealing at least the pressure area towards the outside.

With this embodiment, one single plate will be sufficient, namely the carrier plate. Additional plates can be saved, so that the manufacturing costs can be reduced. On the one hand, this occurs through a smaller material consumption and secondly in that only one carrier plate has to be handled during the assembly of the cylinder head. Further, the carrier plate can be made relatively thin, that is, a carrier plate can be used, which does not have natural stability. On the contrary, the stability of the valve plate arrangement does not occur until the carrier plate is connected to the mechanically sufficiently stable valve cover. However, this connection does not only have the task of ensuring a mechanical reinforcement for the carrier plate. It also has the additional task of providing a gas-tight separation between the suction area and the pressure area on the one side and between the pressure area and the environment on the other side. The connection seam can, for example, be made by welding, soldering or gluing. Thus, a sealing between the carrier plate and the valve cover is saved, which contributes to a further cost reduction. As the carrier plate can be made very thin, a relatively small harmful space occurs, which is particularly important in connection with low-temperature compressors. The small thickness of the carrier plate also results in small pressure losses during the flow of the refrigerant gas through the suction and pressure valves. Further, a working of the surface of the carrier plate can be avoided, at least in large areas.

Preferably, the suction valve has a suction valve element that is located on one side of the carrier plate, and the pressure valve has a pressure valve element that is located on the other side of the carrier plate. The use of suction and pressure valve elements separated by the carrier plate has the advantage that these valve elements can be worked independently of the carrier plate. In particular, it is much easier to provide the valve elements with an edge rounding, which contributes to a long life. This is possible, as, before the assembly of the valve arrangement, the valve elements are accessible from all sides. The valve elements require no additional plate, through which the gas to be compressed would then have to flow.

Preferably, the suction valve element and/or the pressure valve element are connected to the carrier plate by welding or riveting. Accordingly, the carrier plate with valve element or valve elements can be handled and used as one until the manufacturing of the cylinder head. The fixing of the valve elements on the carrier plate can be made automatically.

Preferably, the suction valve element and the pressure valve element are made in the form of fins. These fins are fixed unilaterally, that is, with one end, to the carrier plate and can lift off from the carrier plate with the other end to release a suction opening or a pressure opening. As only the suction valve element and the pressure valve element have to be made of relatively expensive valve material, for example laminar valve steel, the material costs are low.

Preferably, a sealing is arranged between the cylinder head and the compressor block. The sealing provides tightness between the cylinder head and the compressor block. At least in the area, in which the sealing is located, an expensive working or a grinding of the surface of the carrier plate is not required. Here, the carrier plate can still have a certain roughness, as here the sealing rests. On the side next to the valve cover the carrier plate can also have a certain roughness, as here the tightness is provided by the connection seam or the connection seams.

Preferably, the sealing acts upon the suction valve element with a restoring force. Thus, the sealing does not only assume the task of sealing the compression chamber towards the environment, but also the task of quickly restoring the suction valve element after finishing the suction stroke, thus closing the suction valve. An additional spring component can be saved.

Preferably, the sealing rests flat on a sealing area of the carrier plate and comprises a recess for the suction valve element. As long as the suction valve is closed, this causes no or only little deformation of the sealing. Only when the suction valve element is lifted from the carrier plate, the restoring force of the sealing acts upon the suction valve element.

Preferably, the valve cover has at least one wall, which separates a suction gas channel from a pressure gas channel, the connection seam extending on a side of the wall facing the compression chamber. Thus, the wall can be kept relatively thin, so that large flow cross-sections are available for suction gas and pressure gas in the valve cover.

BRIEF DESCRIPTION OF THE DRAWINGS

In the following, the invention is described on the basis of a preferred embodiment in connection with the drawings, showing.

DETAILED DESCRIPTION OF THE PREFERRED EMBODIMENTS

Figure 1:
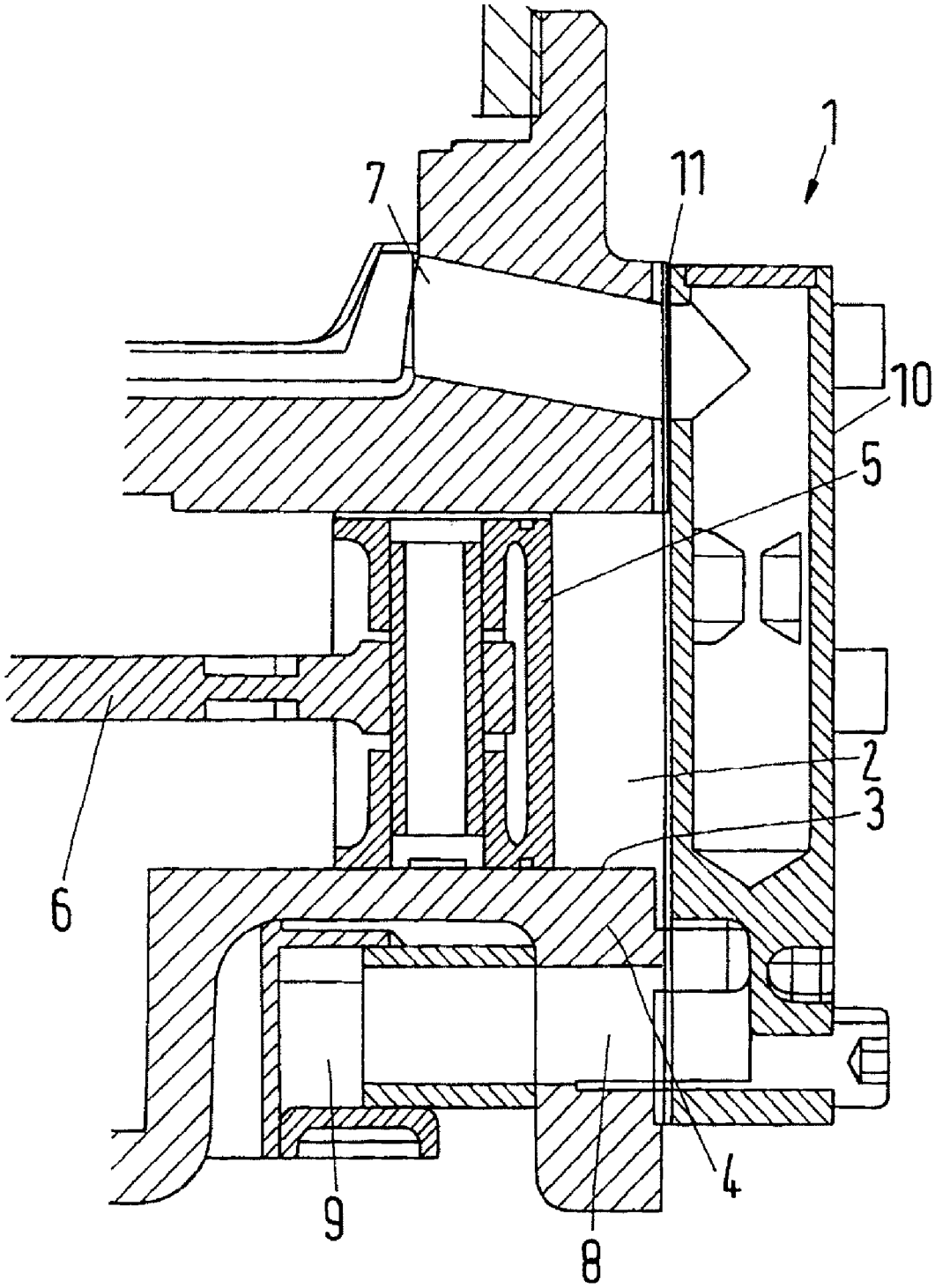
FIG. 1 is a schematic, sectional view of a refrigerant compressor.
Figure 2:
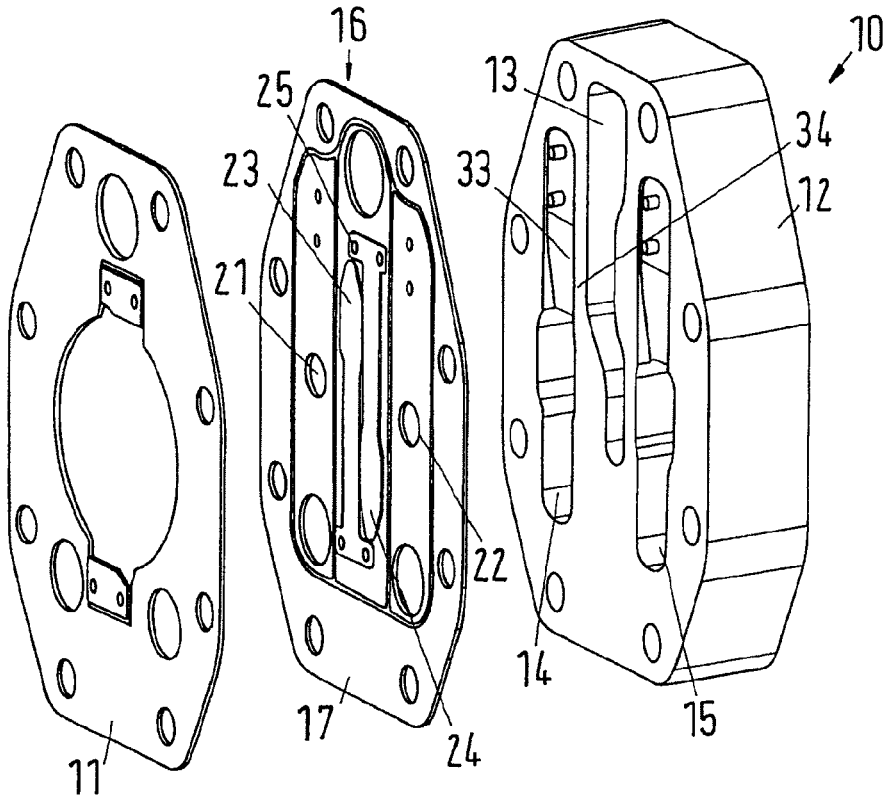
FIG. 2 shows three main elements of a cylinder head in a perspective, exploded view.

FIG. 1 is a schematic view of a refrigerant compressor 1 with a compression chamber 2 formed in a cylinder 3. The cylinder 3 is located in a compressor block 4. The volume of the compression chamber 2 can be changed by means of a piston 5, a drive, not shown in detail, driving the piston 5 to reciprocate via a connecting rod 6.

The cylinder block 4 is located in a suction channel 7, via which refrigerant gas can be sucked into the compression chamber 2. A pressure channel 8 is partly guided through the compressor block 4 and supplies compressed refrigerant gas to a pressure gas collector 9.

A cylinder head 10 closes the compression chamber 2 at the front side of the cylinder 3. Between the cylinder head 10 and the compressor block 4 a sealing 11 is located. In the following, the cylinder head 10 is explained in detail by means of the FIGS. 2 to 5.

The cylinder head 10 has a valve cover 12, in which a suction gas channel 13 and two pressure gas channels 14, 15 are located. The suction gas channel 13 of the valve cover 12 is connected to the suction channel 7 of the compressor block 4. The pressure gas channels 14, 15 are connected to the pressure channel 8 in the compressor block 4 (also more pressure channels 8 can be formed in the compressor block 4).

A valve plate arrangement 16 having a relatively simple design is connected to the valve cover 12. The valve plate arrangement 16 has only one single plate, namely a carrier plate 17. On the side of the carrier plate 17 facing the valve cover 12, two pressure valve elements 18, 19 are arranged and connected to the carrier plate 17 by means of rivets or welding points 20. The two pressure valve elements 18, 19 cover pressure openings 21, 22 in the carrier plate 17. The pressure openings 21, 22 overlap the pressure gas channels 14, 15 in the valve cover.

On the side facing the sealing 11, the carrier plate comprises two suction valve elements 23, 24, which are also connected to the carrier plate 17 by means of rivets or welding points 25. The suction valve elements 23, 24 cover suction openings 26, 27 in the carrier plate 17. The suction openings 26, 27 overlap the suction gas channel 13 in the valve cover 12.

The pressure valve elements 18, 19 and the suction valve elements 23, 24 are formed as fins. These fins can, for example, be made of laminar valve steel, meaning that they are elastically deformable. Accordingly, with the corresponding pressure conditions, their free end can lift off from the carrier plate 17, thus releasing the pressure openings 21, 22 or the suction openings 26, 27. As the fins have a longitudinal shape, the lift-off of the free end from the carrier plate 17 will cause a lateral outflow, also with very small opening degrees, which reduces the losses and thus increases the efficiency of the compressor 1.

The carrier plate 17 is made of a relatively thin sheet metal. Thus, it does not have sufficient natural stability to adopt the pressure forces ruling during operation and acting upon the carrier plate 17 from the cylinder 3 or the valve cover 12. Accordingly, as can be seen from FIG. 4, the carrier plate 17 is welded, soldered or glued onto the valve cover 12. For this purpose, a connection seam 28 is provided, which closes two pressure valve areas 29, 30 towards the outside. A further connection seam 31 separates the pressure valve areas 29, 30 from a suction valve area 32. As can be seen from FIG. 2, the valve cover 12 has, between the suction gas channel 13 and each pressure gas channel 14, 15, a wall 33 with a side 34 facing the compression chamber 2. The connection seam 31 extends on this side 34. This has the advantage that relatively thin walls 33 can be used between the suction gas channel 13 and the pressure gas channels 14, 15, so that an improved flow with small flow losses for the suction and pressure gas can be achieved. The valve cover 12 ensures the mechanical stability of the cylinder head 10 and thus also the carrier plate 17.

The pressure valve elements 18, 19 and the suction valve elements 23, 24 can be worked before being fixed on the carrier plate 17. In particular, here an edge rounding can be made, which contributes to achieving a long life. Contrary to an embodiment, in which the valve elements are still made in a plate, here a grinding tool will have easier access.

As the carrier plate 17 is relatively thin and, particularly, as only one plate is available, which the refrigerant gas must cross during entry into and discharge from the compression chamber 2, small pressure losses occur. Further, the harmful space or dead space remains small, so that a favourable efficiency occurs.

Figure 4:
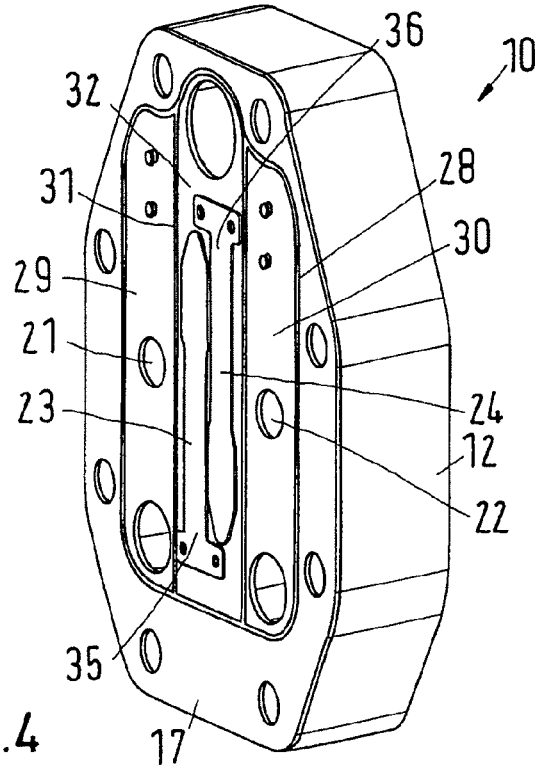
FIG. 4 is a unit of valve plate arrangement and valve cover.
Figure 5:
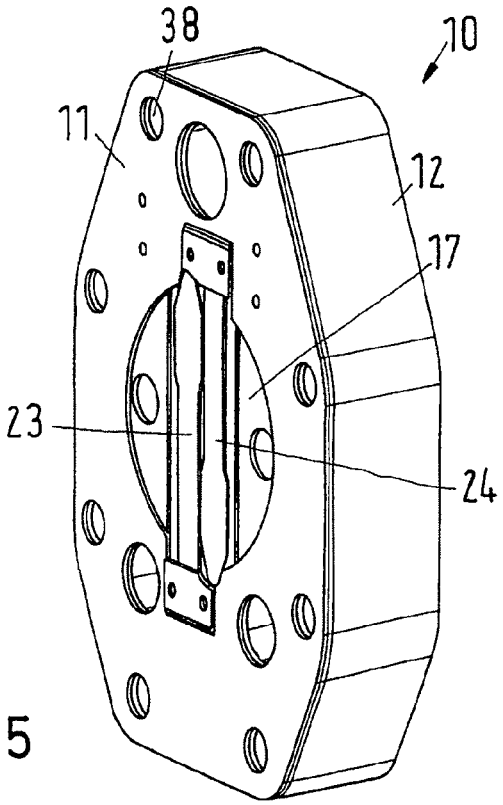
FIG. 5 shows the unit of FIG. 4 with sealing.

As can be seen from a comparison of the FIGS. 4 and 5, the sealing 11 covers the suction valve elements 23, 24 at their fixing area 35, 36 and a small area adjacent to that. This causes that, when the suction valve elements 23, 24 are lifted off from the carrier plate 17 by supplied gas, the sealing 11 is exposed to a restoring force, which brings the suction valve elements 23, 24 back to rest on the carrier plate 17, when the suction flow ends, and this happens relatively quickly and without the need for further spring elements.

Figure 3:
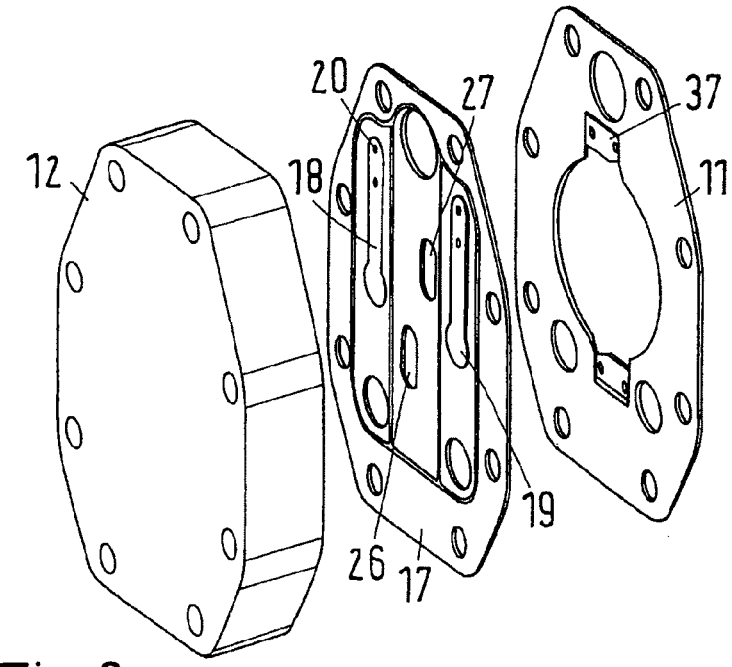
FIG. 3 shows the three elements from another angle of vision.

As is particularly obvious from FIG. 3, the sealing 11 has a recess 37 for each suction valve element 23, 24, the fixing area 35, 36 of each suction valve element 23, 24 entering said recess 37. Accordingly, the sealing 11 can rest on the suction valve elements 23, 24 in a practically tension-free manner or with little pretension, when the cylinder head 10 is mounted on the compressor block 4.

The cylinder head 10 can be fixed on the compressor block 4 by means of screws, which are guided through openings 38 in the cylinder head 10. However, it may also be provided that the cylinder head 10 is welded onto the compressor block 4. In this case, screws or bolts will under certain circumstances not be required.

The embodiments shown have a number of advantages. The carrier plate 17 can be made as a thin punched part, which does not only save material, but also an expensive working or grinding of the surfaces on both sides. In the points, in which the carrier plate 17 rests on the sealing 11, a working is not required. In the points, in which the carrier plate 17 rests on the valve cover 12, a working is not required either, as long as it is ensured that a connection seam 28, 31 can be generated.

A sealing between the carrier plate 17 and the valve cover 12 is saved. Due to the small thickness of the carrier plate 17, a small harmful space occurs, which is particularly important in connection with low-temperature compressors. Due to the connection seam 31, there is no risk that already compressed pressure gas will leak to the suction side.

Due to the small thickness of the carrier plate 17, only small pressure losses occur when the refrigerant gas passes. The sealing 11 assumes some kind of spring function in pressing the suction valve elements 23, 24 against the carrier plate.

Merely for the valve elements 18, 19, 23, 24 an expensive valve material is required. The carrier plate 17, however, can be made of a more cost-effective material. Gaps will not occur around the valve elements 18, 19, 23, 24, which is the case in connection with traditional cylinder heads, in which the valve elements are arranged in plates and manufactured by means of punching.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A piston compressor with a compression chamber in a compressor block, the compression chamber being delimited by a cylinder head, the cylinder head comprising at least one valve plate arrangement with at least one suction valve and at least one pressure valve, as well as a valve cover, wherein the valve plate arrangement is formed by a carrier plate that is a single plate and comprises the suction valve and the pressure valve and is connected by means of at least one gas-tight connection seam to the valve cover, the connection seam separating a suction area and a pressure area from one another and sealing at least the pressure area towards the outside;

wherein the suction valve has a suction valve element that is located on one side of the carrier plate, and the pressure valve has a pressure valve element that is located on the other side of the carrier plate;

wherein a sealing is arranged between the cylinder head and the compressor block;

wherein the sealing acts upon the suction valve element with a restoring force; and wherein the sealing rests flat on a sealing area of the carrier plate and comprises a recess for the suction valve element.

2. The piston compressor according to claim 1, wherein the suction valve element and/or the pressure valve element is connected to the carrier plate by welding or riveting.

3. The piston compressor according to claim 1, wherein the suction valve element and the pressure valve element are made in the form of fins.

4. The piston compressor according to claim 1, wherein the valve cover has at least one wall, which separates a suction gas channel from a pressure gas channel, the connection seam extending on a side of the wall facing the compression chamber.

* * * * *